US010400778B2

(12) United States Patent
Garvin et al.

(10) Patent No.: US 10,400,778 B2
(45) Date of Patent: Sep. 3, 2019

(54) PUMP WITH FRONT DEFLECTOR VANES, WEAR PLATE, AND IMPELLER WITH PUMP-OUT VANES

(71) Applicant: Cornell Pump Company, Clackamas, OR (US)

(72) Inventors: James Garvin, Milwaukie, OR (US); Bryan Enterline, Hillsboro, OR (US); Carl Grompe, Milwaukie, OR (US); Andrew Enterline, Troutdale, OR (US)

(73) Assignee: Cornell Pump Company, Clackamas, OR (US)

( * ) Notice: Subject to any disclaimer, the term of this patent is extended or adjusted under 35 U.S.C. 154(b) by 227 days.

(21) Appl. No.: 15/352,940

(22) Filed: Nov. 16, 2016

(65) Prior Publication Data

US 2017/0138367 A1 May 18, 2017

Related U.S. Application Data

(60) Provisional application No. 62/256,336, filed on Nov. 17, 2015.

(51) Int. Cl.
*F04D 29/22* (2006.01)
*F04D 1/00* (2006.01)
(Continued)

(52) U.S. Cl.
CPC ..... *F04D 29/22* (2013.01); *F04D 1/00* (2013.01); *F04D 7/04* (2013.01); *F04D 29/043* (2013.01);
(Continued)

(58) Field of Classification Search
CPC .. F04D 29/22; F04D 29/2288; F04D 29/2294; F04D 29/445; F04D 29/167;
(Continued)

(56) References Cited

U.S. PATENT DOCUMENTS 3,620,642 A * 11/1971 Studebaker ..... F04D 7/04 415/204
4,802,818 A * 2/1989 Wiggins ..... F04D 7/04 415/172.1
(Continued)

FOREIGN PATENT DOCUMENTS

DE 4128281 A1 3/1993
WO 2012142386 A1 10/2012

*Primary Examiner* — Nathaniel E Wiehe
*Assistant Examiner* — Andrew J Marien
(74) *Attorney, Agent, or Firm* — Snyder, Clark, Lesch & Chung, LLP

(57) ABSTRACT

A centrifugal pump including a pump chamber, a wear plate, and a rotatable impeller is disclosed. The wear plate has a suction inlet. The pump chamber includes a high pressure region around the impeller within the pump chamber. The impeller's front face has portion located adjacent the wear plate to form a recirculation zone in fluid communication with the high pressure region. Another portion of the impeller's front face forms a small running clearance between it and a portion of the wear plate. That running clearance is interposed between the recirculation zone and the suction inlet. The wear plate includes plural deflector vanes projecting into the recirculation zone. A portion of the front face of the impeller includes plural pump-out vanes in the recirculation zone. The deflector vanes cooperate with the pump-out vanes to expel abrasive particles and prevent them from collecting and eroding the running clearance.

12 Claims, 4 Drawing Sheets

(51) Int. Cl.

| | |
|---|---|
| ***F04D 29/043*** | (2006.01) |
| ***F04D 29/44*** | (2006.01) |
| ***F04D 7/04*** | (2006.01) |
| ***F04D 29/16*** | (2006.01) |
| ***F04D 29/42*** | (2006.01) |

(52) U.S. Cl.
CPC ..... *F04D 29/167* (2013.01); *F04D 29/2261* (2013.01); *F04D 29/2266* (2013.01); *F04D 29/2288* (2013.01); *F04D 29/2294* (2013.01); *F04D 29/426* (2013.01); *F04D 29/44* (2013.01); *F04D 29/445* (2013.01)

(58) Field of Classification Search
CPC .... F04D 7/04; F04D 29/2266; F04D 29/2261; F04D 1/00; F04D 29/043; F04D 29/44
See application file for complete search history.

(56) References Cited

U.S. PATENT DOCUMENTS 4,830,572 A * 5/1989 Oklejas, Jr. ..... F01D 5/048 415/110
4,854,820 A 8/1989 Zolotar et al.
5,261,676 A * 11/1993 Rockwood ..... F04D 29/061 277/364
5,489,187 A * 2/1996 Ray ..... B01F 3/04617 415/111
5,591,001 A * 1/1997 Ray ..... B01F 3/04617 261/34.1
5,921,748 A * 7/1999 Frater ..... F04D 29/622 415/128
6,036,434 A 3/2000 Ray et al.
6,210,116 B1 * 4/2001 Kuczaj ..... F04D 1/00 416/185
2007/0274820 A1 * 11/2007 Lindskog ..... F04D 29/167 415/55.1
2010/0221105 A1 * 9/2010 Markovitch ..... F04D 13/10 415/199.1
2011/0129344 A1 * 6/2011 Burgess ..... F04D 29/2288 416/182
2012/0051897 A1 * 3/2012 Davis ..... F04D 29/167 415/196
2013/0189074 A1 * 7/2013 Chen ..... F04D 17/10 415/1
2015/0159503 A1 * 6/2015 Leininger ..... F01D 21/006 60/327
2015/0292519 A1 * 10/2015 Stark ..... F04D 7/04 415/126
2016/0010671 A1 * 1/2016 Shellef ..... F04D 29/106 137/14
2016/0084256 A1 * 3/2016 Drechsel ..... F04D 13/025 417/420
2016/0138604 A1 * 5/2016 Manninen ..... F04D 1/00 416/174
2017/0260993 A1 * 9/2017 Walker ..... F04D 7/045

* cited by examiner

Fig. 3
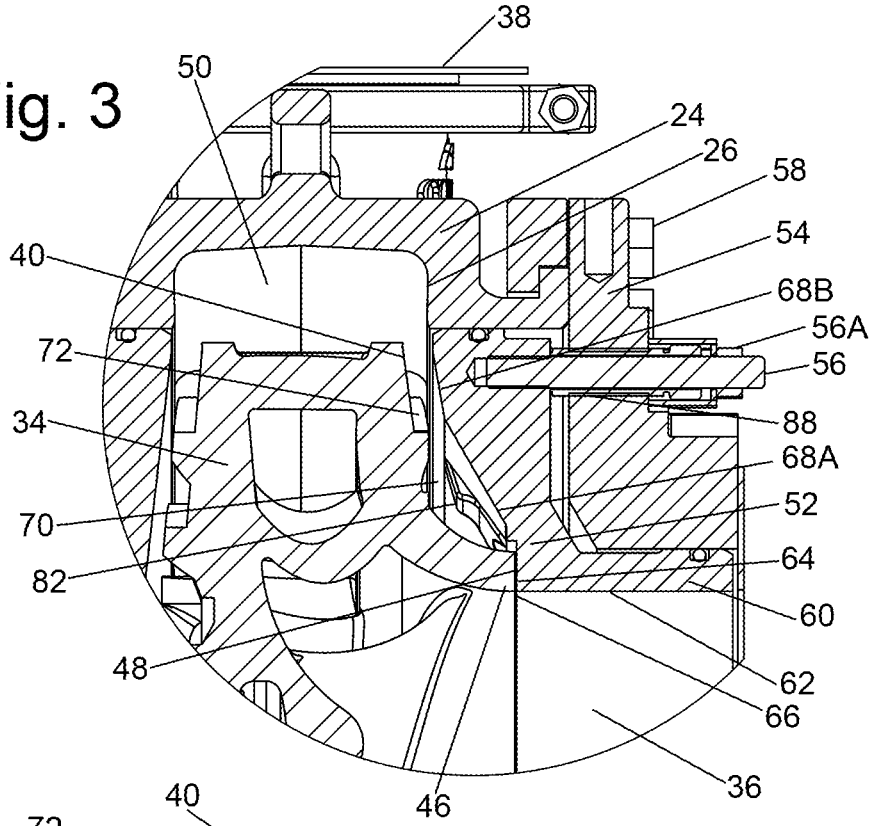
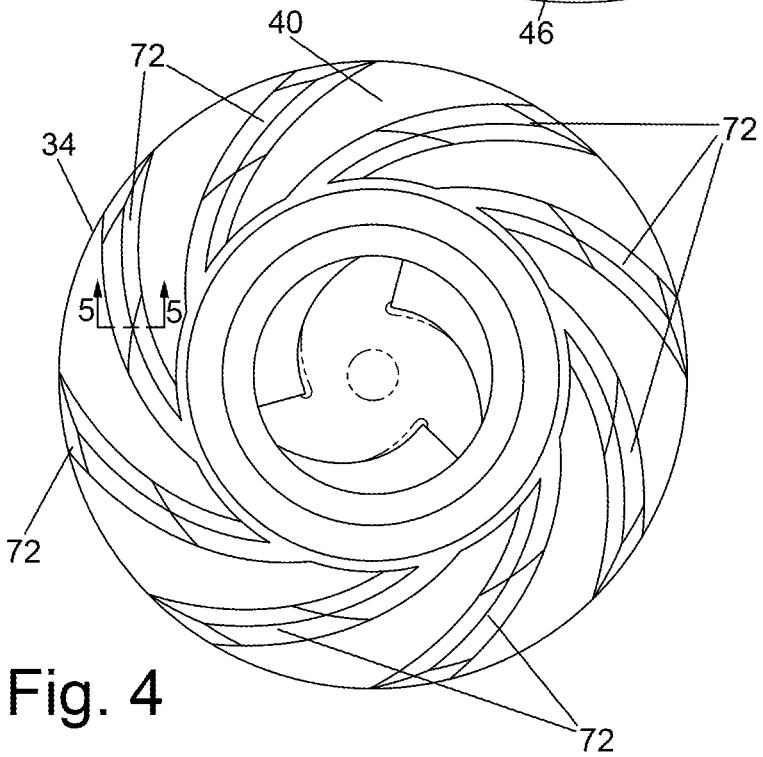
Fig. 4
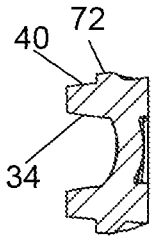
Fig. 5

PUMP WITH FRONT DEFLECTOR VANES, WEAR PLATE, AND IMPELLER WITH PUMP-OUT VANES

CROSS-REFERENCE TO RELATED APPLICATION

The present application claims priority to U.S. Provisional Patent Application No. 62/256,336, filed Nov. 17, 2015, the entirety of which is incorporated by reference herein.

FIELD OF THE INVENTION

The disclosed invention relates to centrifugal pumps, and more particularly to centrifugal pumps for pumping abrasive slurries and which pumps are resistant to abrasive damage at close running clearances at the inlet or low pressure side of the pump.

BACKGROUND OF THE INVENTION

As is known, a centrifugal pump develops hydraulic pressure by rotational kinetic energy to transport a fluid. If the fluid includes abrasive particles, such as slurries produced in the mining industry, centrifugal pumps for pumping those slurries exhibit a tendency of excessive wear on various areas of the pump. For example, in U.S. Pat. No. 5,489,187 (Ray) which is assigned to the same assignee as the subject invention, and whose disclosure is incorporated by reference herein, there is disclosed and claimed an impeller pump including a seal cavity in the high pressure or rear region of the pump, with the seal cavity including a vane structure to flush or clear out debris (e.g., abrasive particles) and entrained air bubbles in the fluid being pumped (the "pumpage").

Another area of a centrifugal pump which is subject to abrasive wear is in the suction area of the centrifugal pump. In particular, within the centrifugal pump during pumping of an abrasive fluid, such as a slurry, the abrasive fluid tends to recirculate from the higher pressure discharge zone to the lower pressure suction inlet due to open clearances between the pump's casing and the pump's rotating impeller. The highest wear zone within the pump typically occurs where the impeller running clearances are closest to the stationary casing of the pump. The grinding of suspended particles against the adjacent surfaces cause pump components to erode. As is known the pump's running clearances are important to the operating performance and integrity of the pump. As this running clearance zone erodes from abrasion, pump components degrade causing the need for replacement and also results in the pump's operating performance to decline.

Thus, a need exists for a centrifugal pump which eliminates or greatly reduces the tendency of the pump to abrade at the close running clearances within the pump at the suction (low pressure) side of the pump. The subject invention addresses that need. In particular, as will be described in detail later, the subject invention makes use of deflector vanes on the suction side of the pump, e.g., on a wear plate mounted in front of the front face of the impeller and which protrude into the recirculation zone. Those deflector vanes interact with the rotating impeller's pump-out vanes located on the front face of the impeller, to thereby expel the abrasive particles and stop them from collecting and eroding the running clearance at the suction inlet. In addition, the deflector vanes tend to break any fluid vortices produced and alleviate the swirling wear against the stationary zone. This effect also slows particles from migrating and collecting at the close running clearance and thus stops or minimizes erosion in this zone. Thus, with the subject invention the hydrodynamic interaction between the front impeller vanes and the deflector vanes creates a dynamic seal that removes the particles from this zone and alleviates surface wear around the running clearances. This action maintains the operating performance and eliminates the need to replace wear parts as frequently. As such, the subject invention reduces the amount of wear on a critical centrifugal pump component, to allow longer part-life, all the while maintaining pump performance.

All references cited and/or identified herein are specifically incorporated by reference herein.

SUMMARY OF THE INVENTION

One aspect of this invention is a centrifugal pump for pumping a fluid containing abrasive particles is provided. The pump comprises a pump chamber, a wear plate, and a rotatable impeller. The wear plate is fixedly secured to the pump chamber and has a suction inlet forming a low pressure region configured for receipt of the fluid. The impeller has a front face and shaft rotatably supporting the impeller within the pump chamber. The pump chamber has a high pressure region located radially outward of the impeller. The shaft has a central axis about which the impeller rotates. The front face of the impeller has a first portion and a second portion. The first portion of the front face is located immediately adjacent a first portion of the wear plate to form a recirculation zone therebetween. The recirculation zone is in fluid communication with the high pressure region. The second portion of the front face is spaced apart from a second portion of the wear plate to form a small running clearance therebetween. The small clearance is interposed between the recirculation zone and the low pressure region. The first portion of the front face of the impeller comprises plural pump-out vanes. The wear plate includes plural deflector vanes distributed circumferentially about the central rotation axis and projecting into the recirculation zone. The deflector vanes are configured to cooperating with the pump-out vanes to expel abrasive particles and prevent them from collecting and eroding the running clearance.

In accordance with one preferred aspect of this invention the first portion of wear plate comprises a concave inner surface and wherein the deflector vanes project toward the first portion of the front face from the concave inner surface. Each of the deflector vanes includes an outer end and an inner end. The outer end is located adjacent the periphery of the concave inner surface. The inner end is located radially inward from the outer end. Each of the deflector vanes is of a generally wedge shape has a wider width at the inner end than at the outer end, with the deflector vanes being equidistantly spaced about the central axis.

In accordance with another preferred aspect of this invention, each of the pump-out vanes extends outward from a respective intermediate point on the front face of the impeller to a respective point immediately adjacent the periphery of the front face of the impeller. Each of the pump-out vanes is arcuate in shape and is of generally U-shape in cross section.

In accordance with another preferred aspect of this invention, the wear plate is adjustable with respect to the impeller whereupon the width of the small running clearance can be adjusted as desired.

BRIEF DESCRIPTION OF THE DRAWING FIGURES

FIG. 3 is an enlarged sectional view of a portion of the pump shown within the circle designated by the reference number 3 in FIG. 2;

FIG. 4 is a front elevation view of the impeller of the pump shown in FIG. 1 and showing the front vanes on the impeller;

FIG. 5 is an enlarged sectional view taken along line 5-5 of FIG. 4, showing the cross-sectional shape of the impeller's front vanes;

DETAILED DESCRIPTION OF THE PREFERRED EMBODIMENTS

Figure 1:
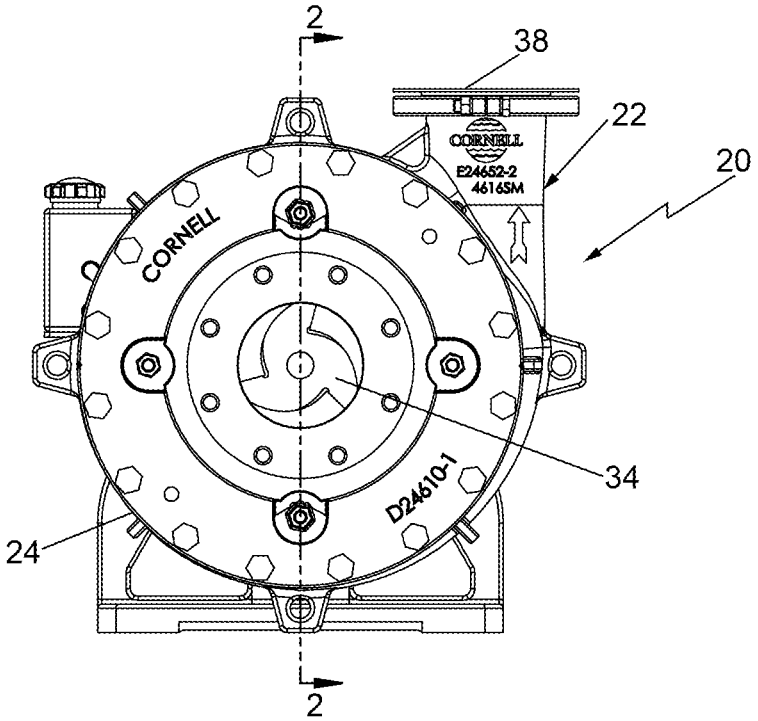
FIG. 1 is a front elevation view of an exemplary impeller pump with front mounted deflector vanes for pumping slurries constructed in accordance with this invention.
Figure 2:
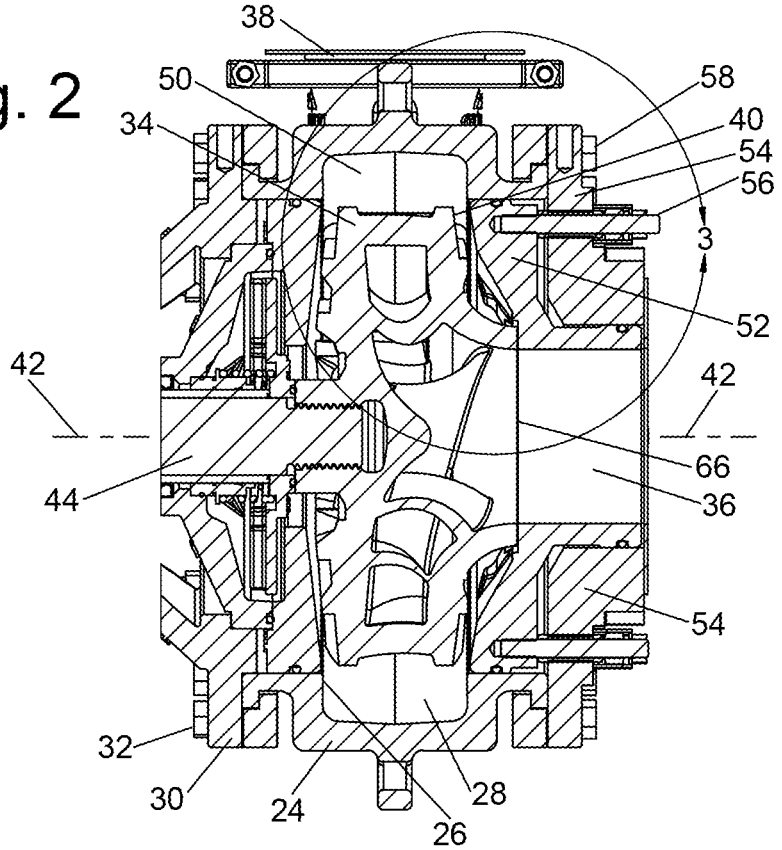
FIG. 2 is an enlarged sectional view taken along line 2-2 of FIG. 1.

Referring now to the drawings wherein like characters refer to like parts there is shown at 20 in FIG. 1 one exemplary embodiment of a centrifugal pump constructed in accordance with this invention. The pump has a casing 22 which includes a front casing section 24, with an internal pump chamber wall 26 defining a pump chamber 28. Also part of the casing is a back casing section 30. Fasteners 32 secure the two casing sections together. The back casing section includes a bearing frame portion (not shown) on which a motor, e.g., an electric motor (not shown) is coupled. A rotatable impeller 34 is located within the pump chamber 28 and produces, on rotation, movement of the liquid, e.g., the slurry, pumped. This liquid enters the pump chamber through an inlet opening 36. Pumped liquid is ejected through a discharge 38. The impeller has a front face 40 (FIGS. 2-4) and is mounted for rotation about central axis on the forward end of an impeller shaft 44. This shaft is coupled to the motor and is configured to be rotated about the axis 42 by the operation of the motor, whereupon the impeller is rotated about that axis within the pump chamber 28.

The details of the impeller 34, and its front face 40, will be described in detail later. Suffice it for now to state that the impeller includes a central tubular projection or hub 46 having a planar front surface 48 (FIG. 3). A plurality of pump-out vanes (to be described later) extend outward from the hub 46 across the front face of the impeller. The pump-out vanes are conventional and common to centrifugal pumps. See for example, U.S. Pat. No. 4,854,820.

The hub 46 is hollow and forms a fluid passageway into the interior of the impeller, so that the fluid, e.g., slurry, which is introduced into the pump will flow through the hub 46 into the interior of the impeller and then out through the communicating passageways in the impeller into an annular high pressure region 50 extending about the periphery of the impeller within the pump chamber 28. The front face 40 of the impeller confronts a wear plate 52 which forms the front of the pump chamber 28. To that end, the wear plate 52 is fixedly secured to the front casing section 24 via a mounting plate 54 and plural hex head screws 58 and plural threaded studs 56 having associated nuts 56A mounted thereon. As best seen in FIGS. 2, 3, 6, and 7, the wear plate is of circular profile and has a front-facing cylindrical sidewall 60 centered on the axis 42. The sidewall 60 includes a central passageway 62 which forms the inlet 36. The surface portion 64 of the wear plate 52 contiguous with the inlet 36 and confronting the impeller is also planar. The interface between the planar surface portion 64 of the wear plate and the planar front surface 48 of the impeller's hub 46 form the pump's running clearance 66. The wear plate 52 is externally axial adjustable, by means of respective threaded bushings 88 which are fixedly secured in the mounting plate 54. In particular, each of the nuts 56A on the threaded studs 56 can be adjusted to twist the associated threaded bushing within its respective bushing 88 to thereby move the wear plate 52 either toward or away from the mounting plate depending upon the direction which the nut is rotated. This action thus moves the wear plate towards or away from the impeller thereby effectively setting the width of the running clearance interface with respect to the impeller. It can be re-adjusted after abrasive wear to regain the clearance.

The portion of the wear plate extending radially outward from the annular portion 64 is dish-like in shape, e.g., is in the form of a concave surface. In the exemplary embodiment shown the concave surface includes a first conical surface portion 68A which is located closely adjacent the annular portion 64, and a second conical surface portion 68B which is located closely adjacent the outer periphery of the wear plate. The conical surface portion 68A extends at a relatively large acute angle, e.g., 30°, to the central longitudinal axis, while the conical surface portion 68B extends at a relatively small acute angle, e.g., 10°, to the central longitudinal axis. It should be noted that the foregoing two angles of the conical surfaces are merely exemplary. As such the angles may be different depending upon the pump model sizes. In any case, the two conical surface portions 68A and 68B together confront the front face 40 of the impeller contiguous with the hub 46 to form a recirculation zone 70. The recirculation zone 70 interconnects and is in fluid communication with the high pressure region 50 of the pump chamber and the pump's running clearance 66, the latter of which is in fluid communication with the suction inlet 36 (i.e., the lower pressure region). It is in the recirculation zone 70 that high abrasion from sliding friction occurs.

As mentioned earlier the wear plate includes plural deflector vanes, to be described shortly, which are distributed circumferentially about the central rotation axis and project into the recirculation zone. The deflector vanes are configured to cooperate with the pump-out vanes on the front face of the impeller to expel abrasive particles and prevent them from collecting and eroding the running clearance.

Before describing the details of the deflector vanes, a description of the pump-out vanes of the impeller is in order. To that end as can be seen in FIG. 4, the front face 40 of the impeller includes a plurality, e.g., eight, generally arcuate vanes 72, which form the pump-out vanes. The pump-out vanes 72 project outward at an acute angle to the hub 46 and terminate at the periphery of the impeller's front face. As best seen in FIG. 5, each vane is of a generally trapezoidal shape in cross section. The pump-out vanes serve to produce fluid pressure in the recirculation region, which thus carries the abrasive particles back into the flow that is being discharged from the pump chamber (otherwise the particles would continue to migrate towards the low pressure suction and the running clearance).

Turning now to FIGS. 6, 7, 10 and 11, the details of the deflector vanes will now be described. Thus, as can be seen there are two sets of deflector vanes. One set includes three deflector vanes 80. The other set includes three deflector vanes 82. The deflector vanes 80 and 82 are interposed with each other and equidistantly disposed about the conical surface 68A. Thus, each deflector vane 80 and 82 projects inward into the recirculation zone 70. While the exemplary embodiment shown includes three deflector vanes 80 and three deflector vanes 82, that is merely exemplary and thus the pump may include other numbers of deflector vanes.

Figure 6:
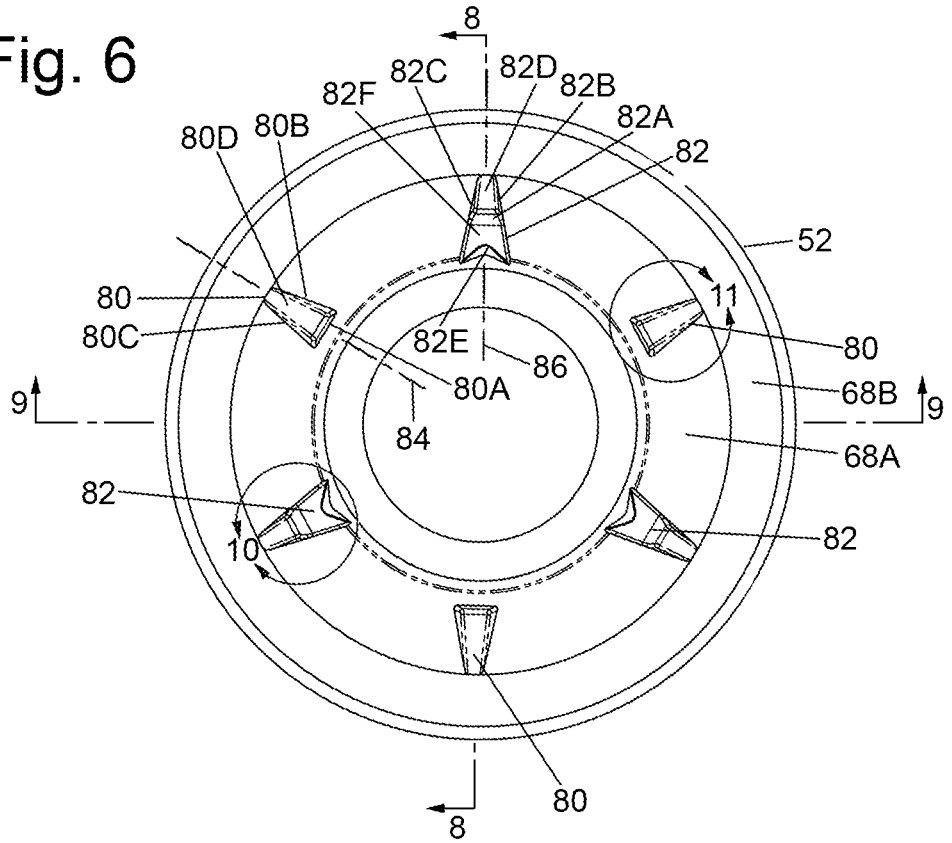
FIG. 6 is a front elevation view of the wear plate of the impeller pump and showing the vanes of the wear plate.
Figure 7:
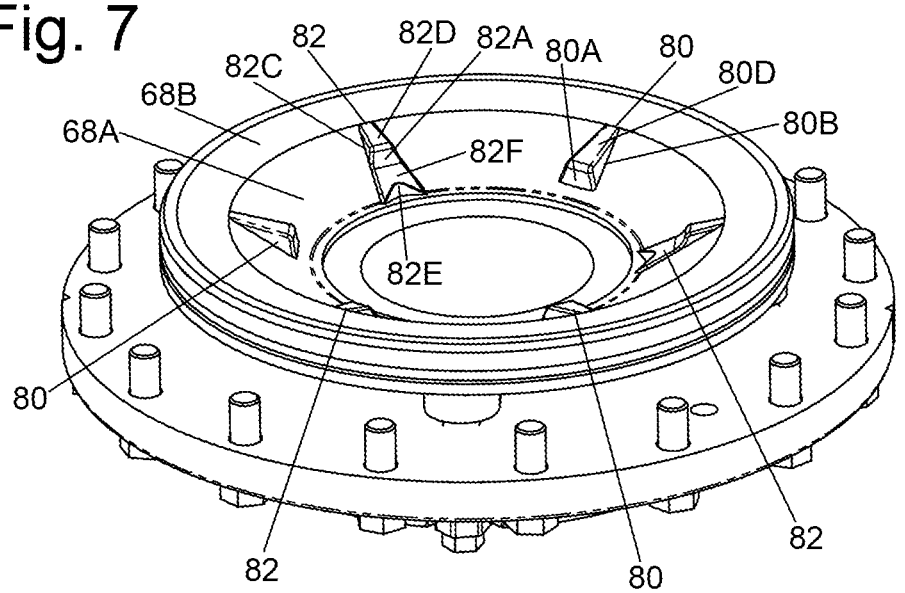
FIG. 7 is an isometric view of the wear plate shown in FIG. 6.
Figure 8:
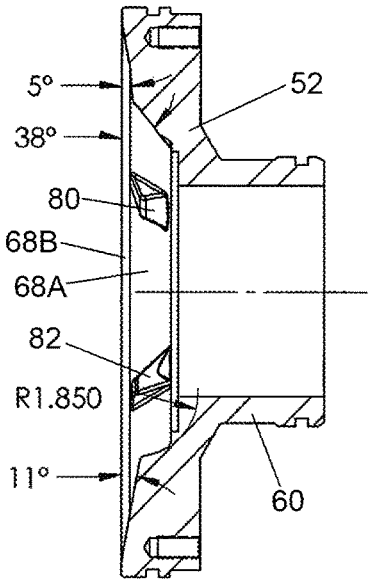
FIG. 8 is a sectional view taken along line 8-8 of FIG. 6.
Figure 9:
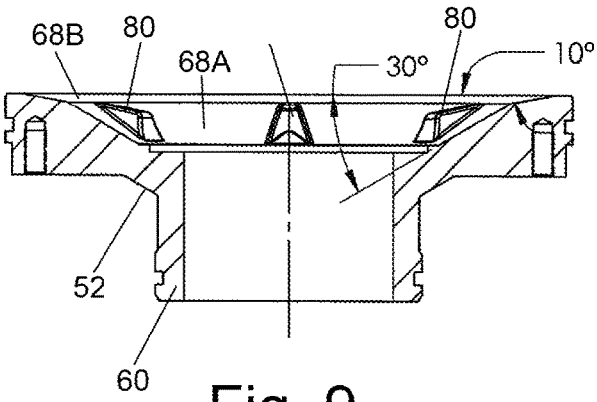
FIG. 9 is a sectional view taken along line 9-9 of FIG. 6.
Figure 11:
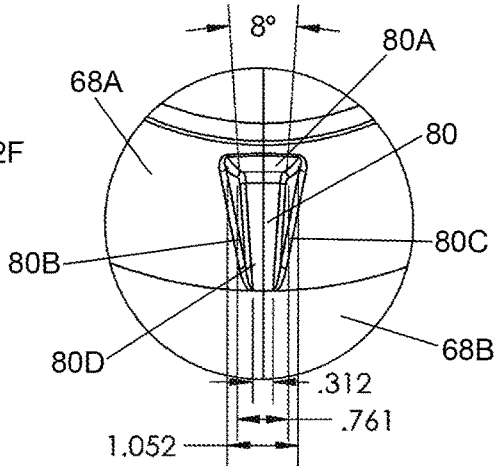
FIG. 11 is an enlarged plan view of the portion of the wear plate shown within the circle designated by the reference number 11 in FIG. 6.

As best seen in FIGS. 6, 7 and 11 each of the deflector vanes 80 has a shape which roughly may be described as a truncated triangle and extends along a radial axis 84. Each vane 80 includes a base 80A, a pair of opposed generally planar sides 80B and 80C extending along the axis 84 and tapering together towards the surface 68B, and a generally planar front face 80D. Each vane 80 projects outwardly from the surface 68A, with its front face 80D extending at only a slight angle relative to a plane perpendicular to the central axis 42 compared to the slope of the inclined (conical) surface 68A, which extends at a greater angle with respect to this plane. By reason of this incline, each vane has an increasing height or greater projection from the surface 68A progressing in a radially inward direction on the wear plate 52. A typical construction of the vane is that its face 80D might extend at an angle of approximately 11° with respect to a plane perpendicular to the axis 42. In comparison, the conical surface 68A might extend at an angle of approximately 30° with respect to this perpendicular plane. Moreover, the angle between the sides 80B and 80C may be 8°. It should be understood that the specific angle values given are exemplary only, and are subject to variation depending upon pump construction.

Figure 10:
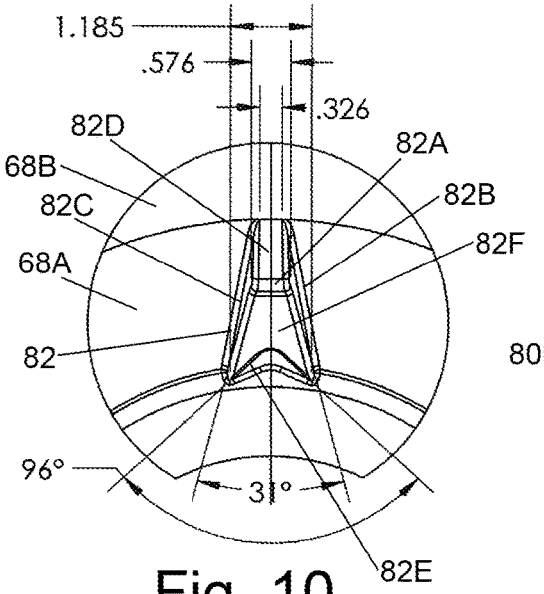
FIG. 10 is an enlarged plan view of the portion of the wear plate shown within the circle designated by the reference number 10 in FIG. 6.

As best seen in FIGS. 6, 7 and 10, each of the deflector vanes 82 has a shape which also roughly may be described as a truncated triangle, with a curved base. However, as can be clearly seen, the vanes 82 are different in construction than the vanes 80. Each vane 82 extends along a radial axis 86 and includes two sections. One section is located closer to the outer conical surface 68B of the wear plate and the other section is located further from that surface. The section of vane 82 located closer to the surface 68B includes an intermediate, downward sloping base 82A, a pair of opposed generally planar sides 82B and 82C extending along the axis 86 and tapering together towards the surface 68B, and a generally planar front face 82D. Each vane 82 projects outwardly from the surface 68A, with its front face 82D extending at only a slight angle relative to a plane perpendicular to the central axis 42 compared to the slope of the inclined (conical) surface 68A, which extends at a greater angle with respect to this plane. The section of vane 82 located further from the surface 68B includes an generally rounded V-shaped concave base 82E, a pair of opposed generally planar sides which constitute extensions of the planar sides 82B and 82C, and a generally planar front face 82F. The front face 82F of the vane section located further from the surface 68B is located at the bottom of the downward sloping intermediate base 82A and extends at the same slight angle relative to a plane perpendicular to the central axis 42 as that of the front face 82D. By reason of the inclines of the front faces 82D and 82F of the vane 82, each section of each vane 82 has an increasing height or greater projection from the surface 68A progressing in a radially inward direction on the wear plate 52. A typical construction of the vane 82 is that its faces 82D and 82F might each extend at an angle of approximately 5° and 38°, respectively, with respect to a plane perpendicular to the axis 42. Moreover, the angle between the sides 82B and 82C may be 31°. It should be understood that the specific angle values given are exemplary only, and are subject to variation depending upon pump construction.

The deflector vanes 80 and 82 produce a circulating action in the pumpage within the recirculation zone. That action results in debris leaving the smaller diameter end of the recirculation zone, i.e., the pump's running clearance 66 to move to the larger diameter end and thence out into the main discharge stream of the pump, i.e., the high pressure region 50. The different geometries of the deflector vanes 80 and 82 prevent resonance from occurring due to symmetry when the pump-out vanes 72 pass them. Moreover, the vanes 80 and 82 are configured so that they are diametrically opposed, i.e., they are 180° apart. Since the diametrically opposed vanes 80 and 82 are of a different shape from each other, their diametrically opposed configuration tends to break the symmetry that would occur if they were the same shape and facilitates the circulation action in the pumpage. The circulation of the pumpage in the recirculation zone created by the deflection vanes 80 and 82 results in flushing of debris from the recirculation zone so as to eliminate wear at the pump's running clearance 66. Each of the vanes 80 is symmetrical about a longitudinally extending plane bisecting the vane, i.e., a plane extending along the radial axis 84. In a similar manner each of the vanes 82 is symmetrical about a longitudinally extending plane bisecting the vane, i.e., a plane extending along the radial axis 86. Thus, the vanes 80 and 82 function in the same manner regardless of the direction in which the impeller is rotated.

As should be appreciated by those skilled in the art, with the subject invention the hydrodynamic interaction between the front impeller vanes and the deflector vanes creates a dynamic seal that removes the particles from this zone and alleviates surface wear around the running clearances. This action maintains the operating performance and eliminates the need to replace wear parts as frequently. Thus the subject invention reduces the amount of wear on a critical centrifugal pump component, to allow longer part-life all the while maintaining pump performance.

Without further elaboration the foregoing will so fully illustrate our invention that others may, by applying current or future knowledge, adopt the same for use under various conditions of service.

What is claimed is:

1. A centrifugal pump for pumping a fluid containing abrasive particles, said pump comprising:

a pump chamber, a wear plate, and a rotatable impeller, said wear plate being fixedly secured to said pump chamber and having a suction inlet forming a low pressure region configured for receipt of the fluid, said impeller having a front face and shaft rotatably supporting said impeller within said pump chamber, said pump chamber having a high pressure region located radially outward of said impeller, said shaft having a central axis about which said impeller rotates, said front face of said impeller having a first portion and a second portion, said first portion of said front face being located immediately adjacent a first portion of said wear plate to form a recirculation zone therebetween, said recirculation zone being in fluid communication with said high pressure region, said second portion of said front face being spaced apart from a second portion of said wear plate to form a small running clearance therebetween, said small running clearance being interposed between said recirculation zone and said low pressure region, said first portion of said front face of said impeller comprising plural pump-out vanes, said wear plate includes plural sets of deflector vanes alternatingly interposed with each other, distributed circumferentially about said central rotation axis, and projecting into said recirculation zone, each of said plural sets of deflector vanes being oriented perpendicularly relative to said central rotation axis, wherein a geometry of the deflector vanes in a first set of the plural sets of deflector vanes is different than a geometry of a second set of the plural sets of deflector vanes, wherein the first set of deflector vanes each include a first front face, wherein the second set of deflector vanes each include a second front face, wherein the first front face has a longer length than the second front face, and wherein said deflector vanes are configured to cooperate with said pump-out vanes to expel abrasive particles and prevent them from collecting and eroding said running clearance.

2. The centrifugal pump of claim 1, wherein said first portion of said wear plate comprises a concave inner surface and wherein said deflector vanes project toward said first portion of said front face from said concave inner surface.

3. The centrifugal pump of claim 2, wherein each of said deflector vanes includes an outer end and an inner end, said outer end being located adjacent the periphery of said concave inner surface, said inner end being located radially inward from said outer end, wherein a plane between a center of the outer end and a center of the inner end is perpendicular to the central rotation axis.

4. The centrifugal pump of claim 3, wherein each of said deflector vanes is of a wedge shape having a wider width at said inner end than at said outer end.

5. The centrifugal pump of claim 1, wherein said deflector vanes are equidistantly spaced about said central axis.

6. The centrifugal pump of claim 1, wherein each of said pump-out vanes extends outward from a respective intermediate point on said front face of said impeller to a respective point immediately adjacent the periphery of said front face of said impeller.

7. The centrifugal pump of claim 6, wherein said small running clearance has a width, and wherein said wear plate is adjustable with respect to said impeller whereupon the width of said small running clearance can be adjusted as desired.

8. The centrifugal pump of claim 6, wherein each of said pump-out vanes is arcuate in shape.

9. The centrifugal pump of claim 8, wherein each of said pump-out vanes includes a U-shape in cross section.

10. The centrifugal pump of claim 8, wherein each of said pump-out vanes is of trapezoidal shape in cross section.

11. The centrifugal pump of claim 1, wherein said small running clearance has a width, and wherein said wear plate is adjustable with respect to said impeller whereupon the width of said small running clearance can be adjusted as desired.

12. The centrifugal pump of claim 2, wherein said small running clearance has a width, and wherein said wear plate is adjustable with respect to said impeller whereupon the width of said small running clearance can be adjusted as desired.

* * * * *